US005452508A

United States Patent [19]

Wu

[11] Patent Number: 5,452,508

[45] Date of Patent: Sep. 26, 1995

[54] METHOD FOR MANUFACTURING SURFACE THREE-DIMENSIONAL FIGURES ON MAGNETIC MATERIAL

[76] Inventor: Michael Wu, 4 Fl, 38 Alley 1, Lane 95, Chung Tang N.Rd. SE C.2, Peitou, Taipei, Taiwan, Prov. of China

[21] Appl. No.: 130,750

[22] Filed: Oct. 4, 1993

[30] Foreign Application Priority Data

Apr. 14, 1993 [CN] China ..... 93104272

[51] Int. Cl.[6] ..... B21D 39/00

[52] U.S. Cl. ..... 29/428; 29/DIG. 95; 156/220; 264/293; 428/900; 40/600; 40/616

[58] Field of Search ..... 29/527.1, 527.2, 29/DIG. 95, 428; 428/900, 159; 40/600, 621, 616; 156/220; 264/293

[56] References Cited

U.S. PATENT DOCUMENTS

| | | | |
|---|---|---|---|
| 2,599,047 | 6/1952 | Clark | 428/900 |
| 3,756,888 | 9/1973 | Kuroda | 156/220 |
| 3,839,130 | 10/1974 | Dean et al. | 40/621 |
| 3,908,065 | 9/1975 | Stigen | 428/900 |
| 3,978,258 | 8/1976 | Faust et al. | 156/220 |
| 4,310,978 | 1/1982 | Stern | 40/600 |

*Primary Examiner*—David P. Bryant

*Attorney, Agent, or Firm*—Jacobson, Price, Holman & Stern

[57] ABSTRACT

A method for manufacturing three-dimensional surface figures on a soft magnetic material. An insulating layer is first laid on a soft magnetic material layer and a foam intermediate layer is then laid on the insulating layer. A face layer previously printed with figures is finally laid on the intermediate layer. Thereafter the face layer is embossed and molded with concave/convex three-dimensional figures corresponding to the present embossing stripes of a molding device by a high frequency device so as to provide an improvement over conventional three-dimensional figures made by injection molding which cannot have figures printed by halftone block printing or color separation so as to eliminate the shortcomings existing in planar printed magnetic products which are only printed with planar figures.

4 Claims, 3 Drawing Sheets

METHOD FOR MANUFACTURING SURFACE THREE-DIMENSIONAL FIGURES ON MAGNETIC MATERIAL

BACKGROUND OF THE INVENTION

The present invention relates to a method for manufacturing surface figures having a bare layer of soft solid magnetic material and a product resulting from the method, wherein an insulating layer, a foam intermediate layer and a face layer previously printed with figures are attached on a layer of soft magnetic material, and then the product is embossed and molded with color decorative concave/convex solid figures by means of a high frequency molding device so as to improve the shortcomings of conventional solid figures made by means of injection molding where the colors are injected or painted by hand and much time and labor are wasted and so to eliminate the shortcoming existing in planar printed magnetic products which are only printed with planar figures.

In referring to FIG. 1, which shows a pattern of a conventional soft: decorative product, a face layer 13 is shown printed with plane FIGS. 12 attached on a surface of a magnetic layer 10. Because the face layer 13 is planar, the current-printing color separating technique can be employed to freely vary the shapes and colors of the figures.

However, such figures are not three-dimensional. Another pattern of a conventional soft decorative product is shown in FIG. 2, wherein a rubber magnetic material is injected by a rubber injecting machine and molded to form a product 21 having surface concave/convex FIGS. 20. Then, the concave/convex figures 20 are injected or painted with colors by labor as necessary. Although such figures are three-dimensional, halftone block printing or color printing techniques cannot be employed to form the figures. As a result, the figures are monotonous and cannot be mass-produced by a machine so that the manufacturing cost is high.

SUMMARY OF THE INVENTION

It is therefore a primary object of the present invention to provide a method for manufacturing surface figures of soft solid magnetic material and a product resulting from the method, wherein the product is embossed and molded with three-dimensional concave/convex color figures by means of modern printing techniques and high frequency molding technique to improve the surface figures of the decorative magnetic product.

The structure, features, functions, and other objects of the present invention, and the technical means adopted to achieve the present invention can be best understood through the following detailed description of the preferred embodiment and the accompanying drawings wherein:

BRIEF DESCRIPTION OF THE DRAWINGS

FIGS. 3-1, 3-2 and 3—3 show three embodiments of the present invention.

DETAILED DESCRIPTION OF THE PREFERRED EMBODIMENTS

Figure 1:
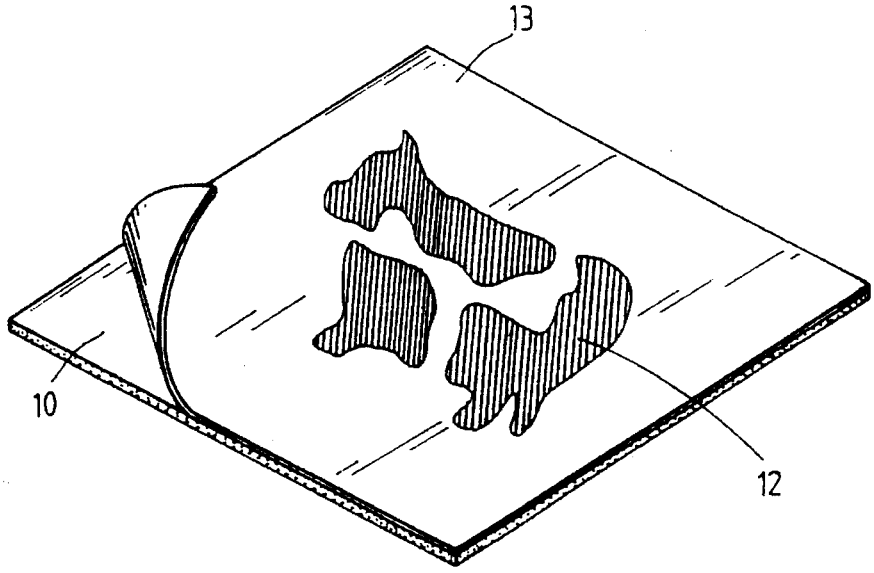
FIG.1 (PRIOR ART)
FIG. 1 shows a pattern of the conventional soft magnetic product with planar figures.
Figures 1, 3:
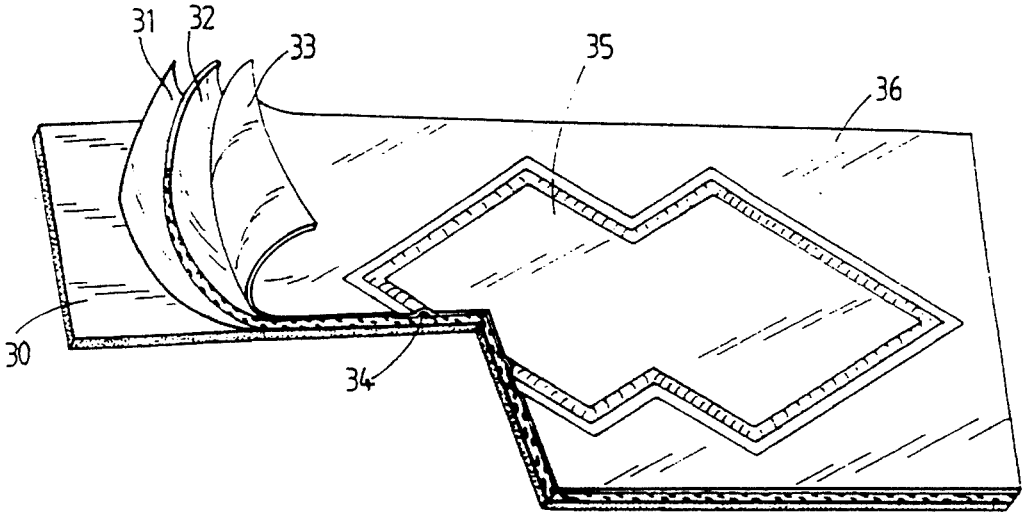
Figures 2, 3:
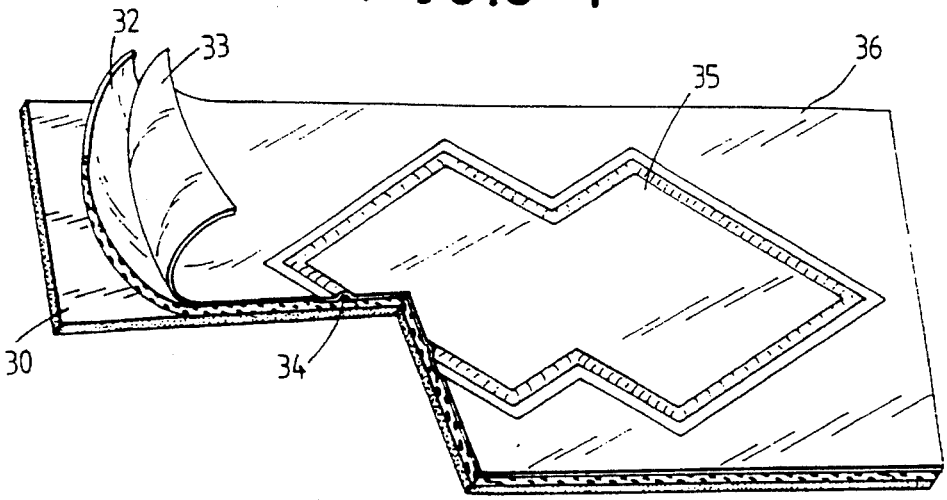
Figure 3:
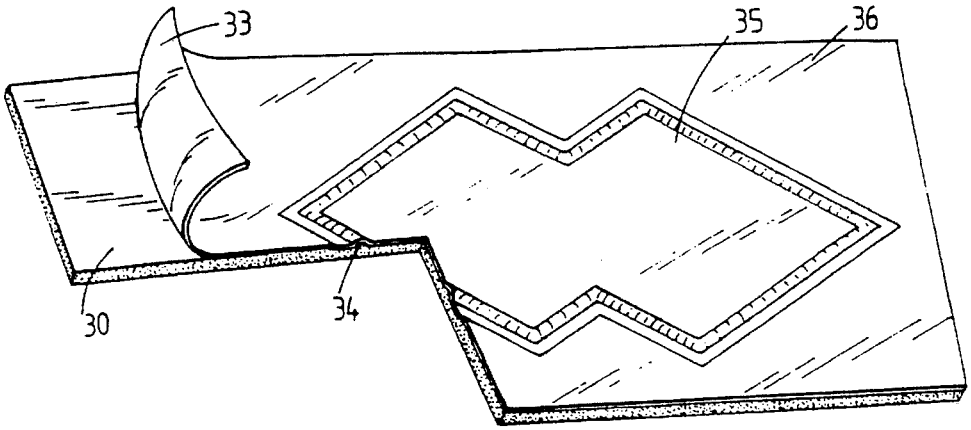
Figure 4:
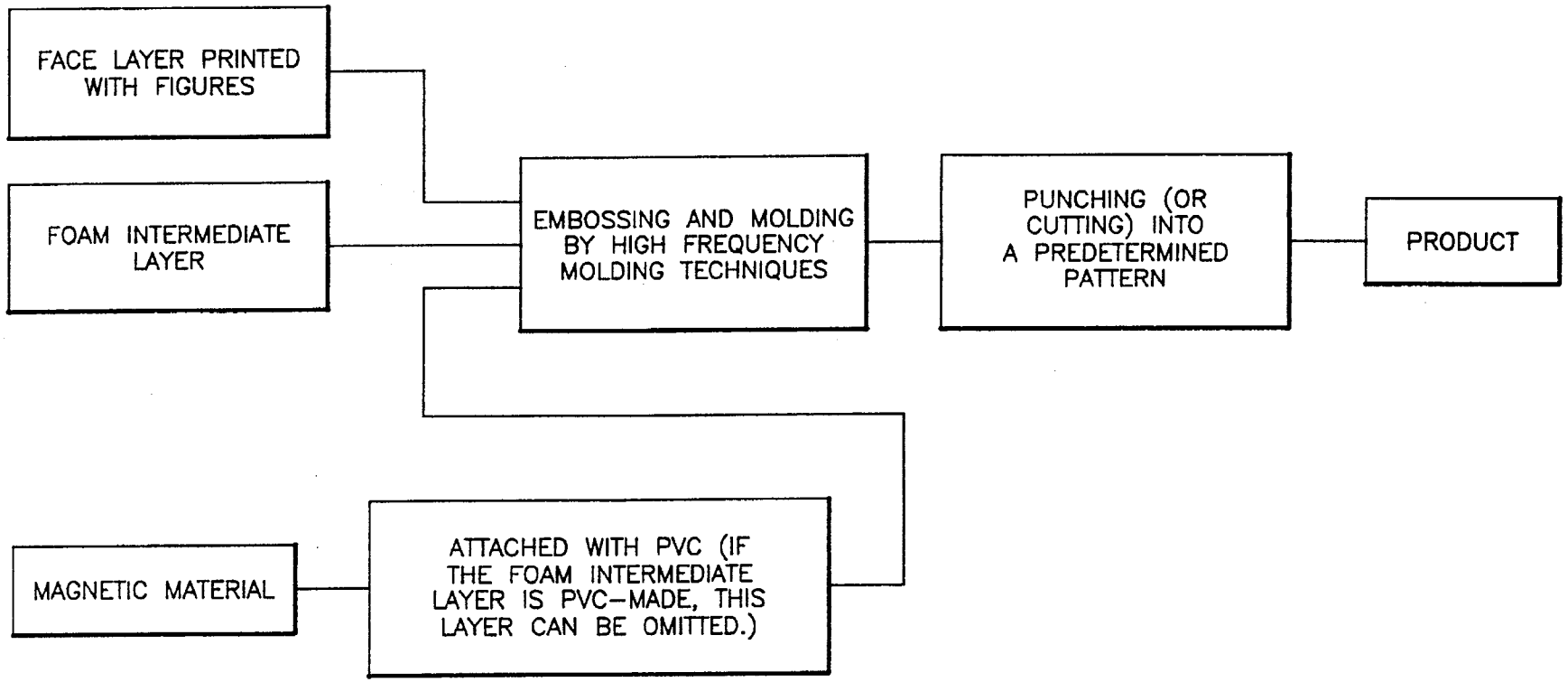
FIG. 4 is a manufacturing flow chart of the present invention.

Please refer to FIGS. 3-1 and 4. The present invention is composed of a soft magnetic material layer 30, an insulating layer 31 (such as a layer made of PVC) attached thereon, a foam intermediate layer 32 laid on the insulating layer 31, and a face layer 33 previously printed with figures to ultimately form a three-dimensional surface 35 formed with concave/convex stripes 34. The magnetic material layer 30 is then punched or cut to a predetermined size in a blade mold to form a predetermined peripheral shape 36. The soft magnetic product manufactured according to the above arrangement not only can achieve the object of freely varying the colors by means of employing the techniques of halftone block printing or color separation but also can be embossed with three-dimensional concave/convex figures by high frequency molding techniques to provide an improvement over conventional three-dimensional figures made by means of injection molding which cannot lay out the figures by halftone block printing or color separation techniques. The above arrangements can also improve the shortcoming existing in planar printed magnetic products which are only printed with planar figures.

According to the above arrangements, the insulating layer 31, foam intermediate layer 32 and face layer 33 with the figures can be previously embossed with concave/convex stripes and then attached on the magnetic material layer 30 to achieve the same effect.

Figure 2:
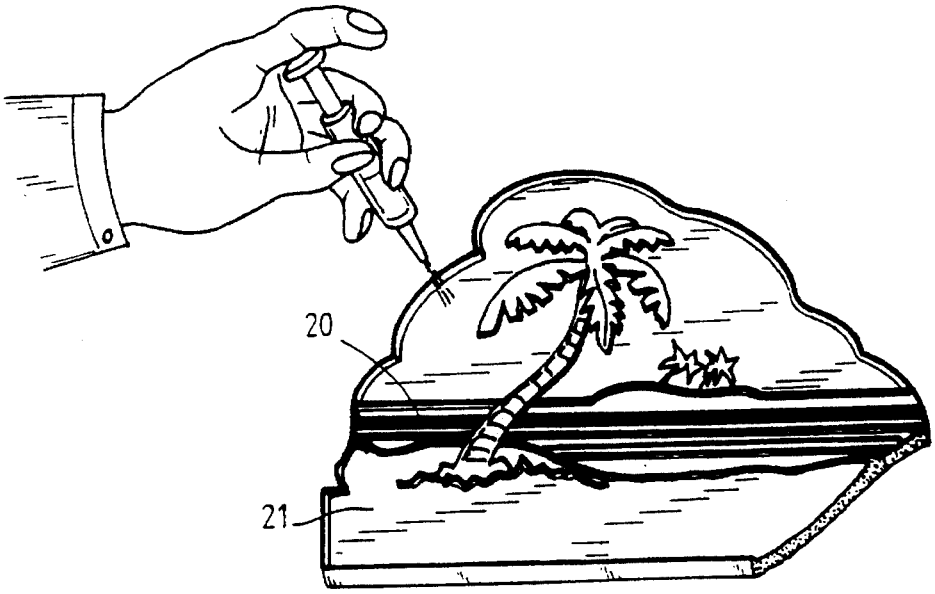
FIG.2 (PRIOR ART)
FIG. 2 shows another pattern of the conventional soft magnetic product with concave/convex three-dimensional figures.

Moreover, referring to FIG. 3-2, in case the foam intermediate layer 32 is made of the insulating PVC material, then the insulating layer 31 originally laid between the magnetic material layer 30 and the intermediate layer 32 can be omitted to achieve the same effect. FIG. 3—3 shows that the insulating layer 31 and intermediate layer 32 are both omitted and only one single thicker insulating face layer 33 printed with color figures is molded by high frequency embossing techniques to achieve the same concave/convex three-dimensional surface.

In conclusion, the present invention provides a novel method for manufacturing surface figures of a soft magnetic product in combination with modern printing and solid molding techniques. Therefore, the product can be manufactured fast at low cost.

It is to be understood that the above description and drawings are only used for illustrating one embodiment of the present invention, and are not intended to limit the scope of the present invention. Any variation and derivation from the above description and drawings should be included in the cope of the present invention.

What is claimed is:

1. A method for manufacturing a magnetic product, comprising the following steps:

attaching an insulating layer on a surface of a soft magnetic material layer;

laying a foam intermediate layer on said insulating layer;

laying a face layer previously printed with surface figures on said foam intermediate layer, thereby forming a multilayer subassembly;

forming decorative concave/convex surfaces in said insulating layer, said foam intermediate layer and said face layer of said multilayer subassembly; and cutting said multilayer subassembly into a predetermined pattern including said decorative concave/convex surfaces.

2. A method as claimed in claim 1, wherein said insulating layer, said intermediate layer and said face layer are made of PVC material.

3. A method for manufacturing a magnetic product, comprising the following steps:

attaching a decorative face layer formed with concave/convex surfaces on a side of a soft magnetic material layer to form a multilayer subassembly, said decorative face layer including an insulating layer, a foam intermediate layer, and a top printed face layer formed with concave/convex three dimensional surfaces; and cutting said multilayer subassembly into a predetermined pattern including said concave/convex surfaces.

4. A method as claimed in claim 3, wherein said insulating layer, said intermediate layer and said printed face layer are made of PVC material.

* * * * *